US008025351B2

(12) United States Patent
Ishida

(10) Patent No.: US 8,025,351 B2
(45) Date of Patent: Sep. 27, 2011

(54) RECORDING APPARATUS HAVING CARRIAGE GUIDE MEMBERS FOR MAINTAINIG PARALLELISM BETWEEN A RECORDING HEAD AND RECORDING MEDIUM

(75) Inventor: Takaaki Ishida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 8 days.

(21) Appl. No.: 12/333,278

(22) Filed: Dec. 11, 2008

(65) Prior Publication Data

US 2009/0152794 A1 Jun. 18, 2009

(30) Foreign Application Priority Data

Dec. 14, 2007 (JP) ..... 2007-323328

(51) Int. Cl.
*B41J 25/308* (2006.01)
*B41J 23/00* (2006.01)
*B41J 11/20* (2006.01)

(52) U.S. Cl. ..... 347/8; 347/37; 400/55

(58) Field of Classification Search ..... 347/8, 37; 400/59

See application file for complete search history.

(56) References Cited

U.S. PATENT DOCUMENTS

| | | | | |
|---|---|---|---|---|
| 5,065,169 | A * | 11/1991 | Vincent et al. | 347/8 |
| 5,975,778 | A * | 11/1999 | Kanemitsu | 400/59 |
| 6,315,468 | B2 | 11/2001 | Kishida | |
| 6,789,966 | B2 * | 9/2004 | Tanaka et al. | 400/59 |
| 6,899,474 | B2 | 5/2005 | Uchida | |
| 2003/0081022 | A1 * | 5/2003 | Lim et al. | 347/8 |
| 2006/0209104 | A1 * | 9/2006 | Naruse | 347/8 |
| 2008/0007593 | A1 * | 1/2008 | Buonerba et al. | 347/37 |
| 2008/0024530 | A1 * | 1/2008 | Schalk et al. | 347/8 |

* cited by examiner

*Primary Examiner* — Shelby Fidler
(74) *Attorney, Agent, or Firm* — Canon USA Inc IP Division

(57) ABSTRACT

A recording apparatus includes guide rails that each control the posture of a carriage at an arbitrary recording position by being in contact with the carriage. The guide rails are disposed on respective sides of a guide shaft in a direction in which a recording medium is conveyed. The length of a gap between the recording medium and the carriage is selectable between a case where the carriage is in contact with one of the guide rails and a case where the carriage is in contact with the other guide rail. Such a configuration provides a compact and low-cost recording apparatus capable of performing recording on recording media having various thicknesses by appropriately adjusting the gap between the carriage and any of the recording medium while maintaining the parallelism therebetween.

7 Claims, 15 Drawing Sheets

RECORDING APPARATUS HAVING CARRIAGE GUIDE MEMBERS FOR MAINTAINIG PARALLELISM BETWEEN A RECORDING HEAD AND RECORDING MEDIUM

BACKGROUND OF THE INVENTION

1. Field of the Invention

The present invention relates to recording apparatuses such as printing apparatuses and image forming apparatuses, and in particular to recording apparatuses capable of performing recording on recording media of various thicknesses by appropriately adjusting a gap between a recording unit, such as a recording head, and any of the recording media.

2. Description of the Related Art

In a general recording apparatus that performs recording on a target surface of a recording medium while moving a recording head back and forth along a guide member, it is desirable that parallelism between the target recording surface and a surface of the recording head be adjusted with high accuracy. To appropriately perform recording on recording media having different thicknesses, it is also desirable that a gap between the recording head and the target surface of any of the recording media be maintained in an appropriate manner even if the thickness of the recording medium, such as paper or the like, is changed.

There are various recording media proposed as a target of recording performed by recording apparatuses such as printing apparatuses and image forming apparatuses. Exemplary media of small size and having relatively large thicknesses include compact discs-recordable (CD-Rs), digital versatile discs (DVDs), and cards (which are hereinafter collectively referred to as CDs). In known general-purpose recording apparatuses, use of a conveying path for cut paper in performing recording on a CD, for example, triggers problems in that the CD is not conveyed appropriately or is damaged with scars because of high rigidity of the CD, or the CD cannot be conveyed because of the distance between conveying rollers. To avoid such problems, when a small-sized recording medium having a large thickness such as a CD is conveyed, the medium is fed with a dedicated tray and is conveyed therewith along a conveying path different from the conveying path for cut paper.

In general, a tray dedicated for performing recording on a CD has a thickness of about 3 mm. In contrast, cur paper such as glossy paper for photographic printing has a thickness of about 0.25 mm. To appropriately perform recording on various recording media ranging from glossy paper to CDs, a gap adjusting mechanism capable of adjusting the gap between the recording head and the recording medium within a wide range of about 3 mm is required.

A recording apparatus capable of accommodating various paper thicknesses while maintaining parallelism between the surface of a recording head and the target surface of a recording medium is disclosed in U.S. Pat. No. 6,899,474. Referring to FIG. 15, in the recording apparatus of U.S. Pat. No. 6,899,474, when an eccentric cam 521 fitted to a guide shaft 52 serving as a guide member is rotated, the guide shaft 52 is moved vertically in a direction A in which the gap between the recording head and the recording medium is adjusted, whereby a carriage 50 having a recording head 55 is guided in a vertical direction B. In this case, a controlling guide member 114 that controls the posture of the carriage 50 is provided in such a manner as to have the surface thereof being parallel to the direction in which the gap is adjusted. Thus, the aforementioned parallelism is maintained and capability of accommodating various paper thicknesses is realized.

Another recording apparatus is disclosed in U.S. Pat. No. 6,315,468. This recording apparatus includes a plurality (two, for example) of guide shafts that guide the movement of a recording head. The guide shafts are provided at respective ends thereof with eccentric cams. These eccentric cams are rotated synchronously, whereby the plurality of guide shafts are synchronously raised and lowered. Thus, the parallelism between a recording medium and the recording head is maintained.

In the recording apparatuses disclosed in U.S. Pat. Nos. 6,899,474 and 6,315,468, however, it is difficult to provide a simple configuration that realizes reduction of both the size of the apparatus body and the manufacturing cost.

Specifically, in the recording apparatus disclosed in U.S. Pat. No. 6,899,474, the controlling guide member controlling the posture of the carriage needs to have a surface parallel to the gap adjusting direction so as to maintain the parallelism between the recording medium and the recording head. Moreover, the controlling guide member needs to be provided at an appropriate distance from the guide shaft for the purpose of securing stable movement of the carriage. That is, the controlling guide member needs to be provided above a region where the carriage moves. This results in a restriction in terms of the height of the apparatus (see reference numeral 114 in FIG. 15).

On the other hand, the recording apparatus disclosed in U.S. Pat. No. 6,315,468 includes a plurality of movable members, the guide shafts, used for gap adjustment. This results in complexity of the mechanism for driving such members. Moreover, in terms of maintaining the parallelism between the recording head and the recording medium, it is difficult to obtain high accuracy because the recording head is positioned with a plurality of cams. Consequently, image quality tends to be deteriorated.

SUMMARY OF THE INVENTION

The present invention provides a compact and low-cost recording apparatus capable of performing recording while adjusting a gap and maintaining parallelism between a recording medium and a recording head.

According to an aspect of the present invention, a recording apparatus includes a carriage having a recording unit configured to perform recording on a recording medium, the carriage being movable in a direction crossing a recording medium conveying direction; a carriage guiding member configured to guide the movement of the carriage and on which the carriage is rotatably supported, the height of the carriage guiding member being changeable, whereby the carriage is raised and lowered; and first and second guide members configured to be in contact with the carriage in such a manner as to control the posture of the carriage, the first and second guide members being disposed on respective sides of the carriage guiding member in the recording medium conveying direction. The length of a gap between the recording medium and the recording unit is selectable between a case where the carriage is in contact with the first guide member and a case where the carriage is in contact with the second guide member.

Further features of the present invention will become apparent from the following description of exemplary embodiments with reference to the attached drawings.

BRIEF DESCRIPTION OF THE DRAWINGS

FIG. 7B is a side view schematically showing the position of the right eccentric cam and the posture of the carriage at the CD printing height.

DESCRIPTION OF THE EMBODIMENTS

Exemplary embodiments of the present invention will now be described with reference to the drawings.

Figure 1:
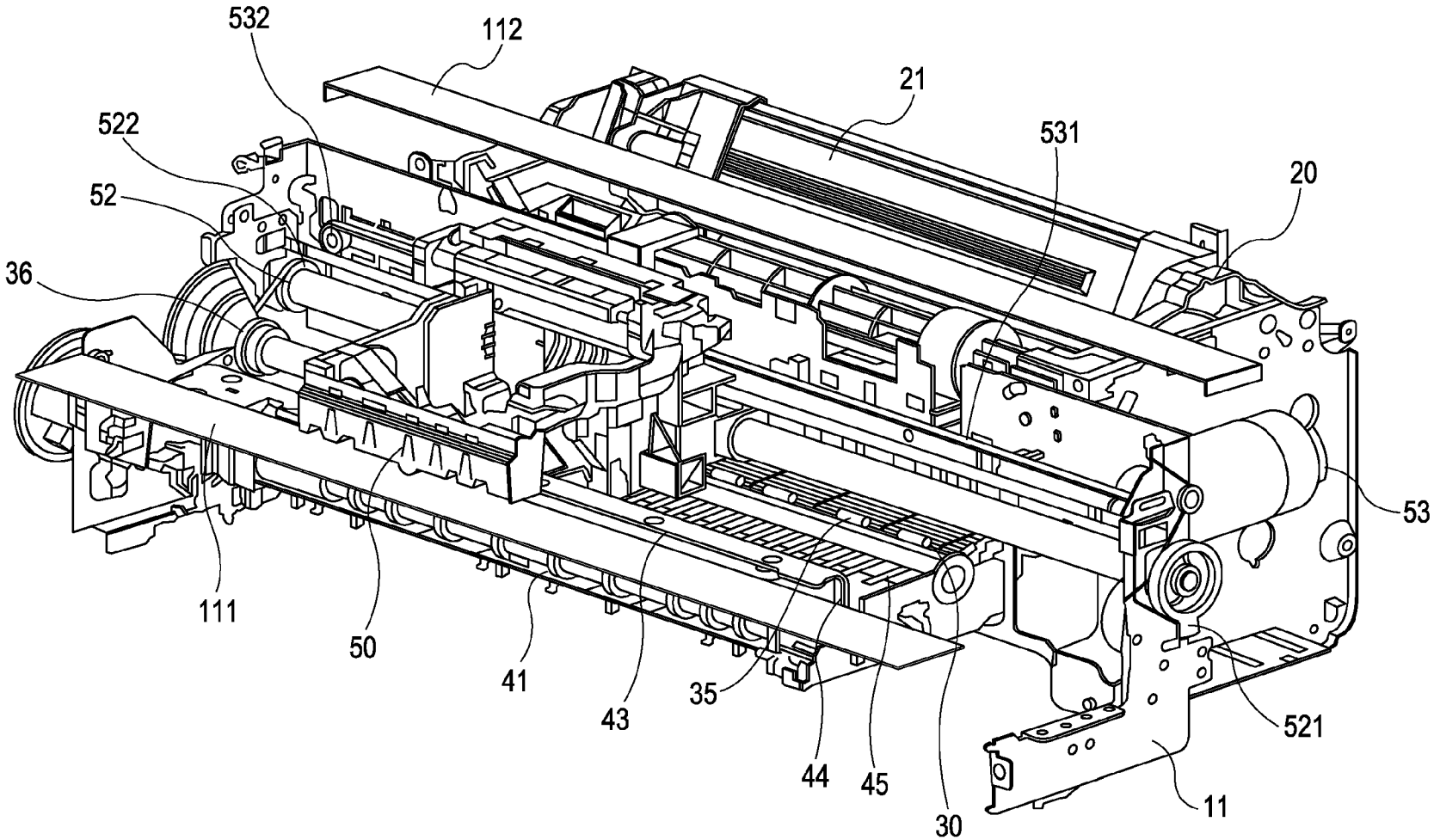
FIG. 1 is a perspective view of internal mechanisms of a recording apparatus according to a first embodiment of the present invention, seen from the front right.
Figure 2:
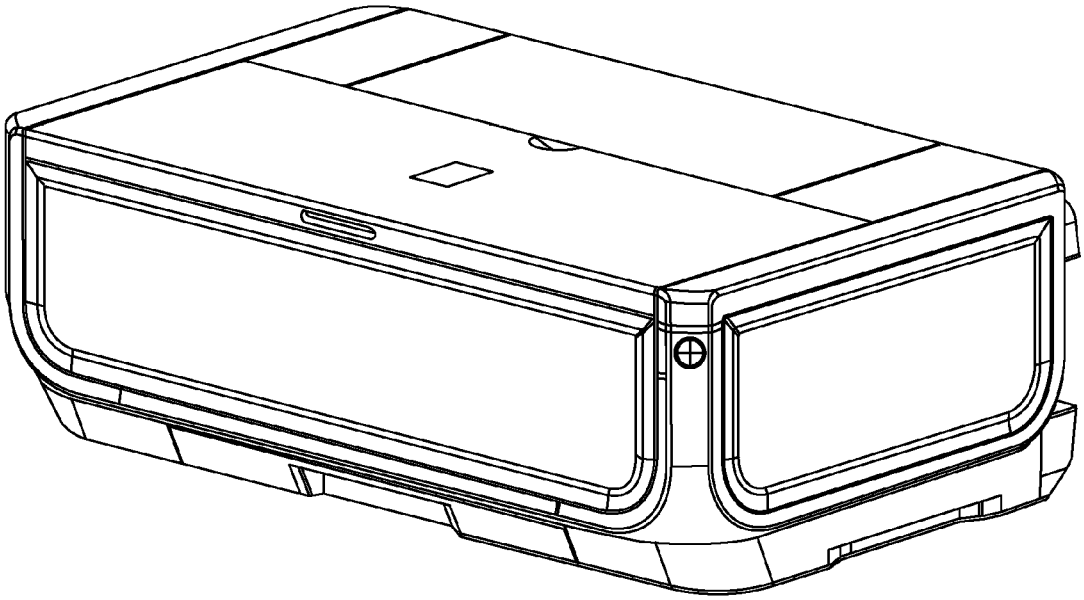
FIG. 2 is an outer perspective view of the recording apparatus shown in FIG. 1.
Figure 3:
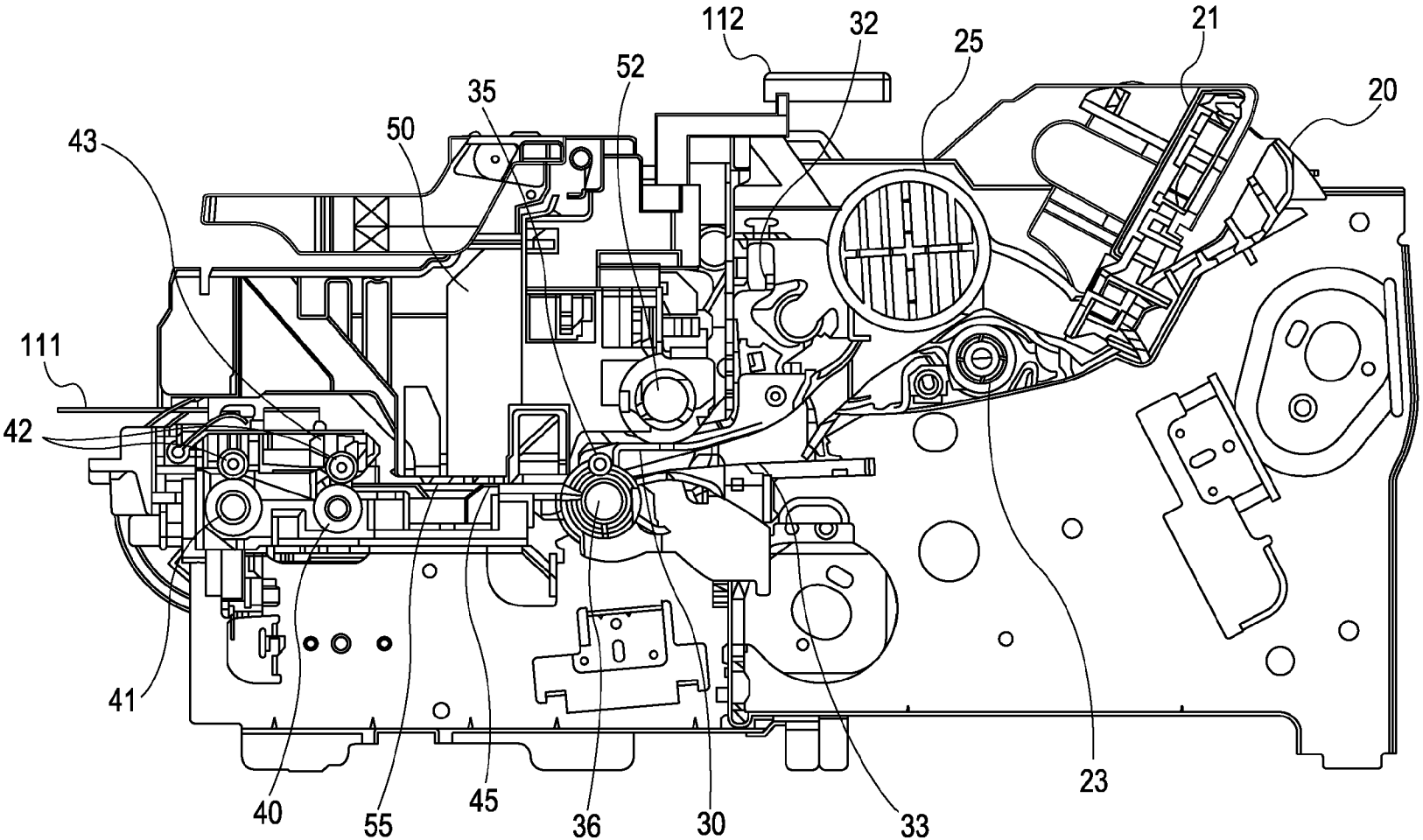
FIG. 3 is a cross-sectional view of the recording apparatus shown in FIG. 1.
Figure 4:
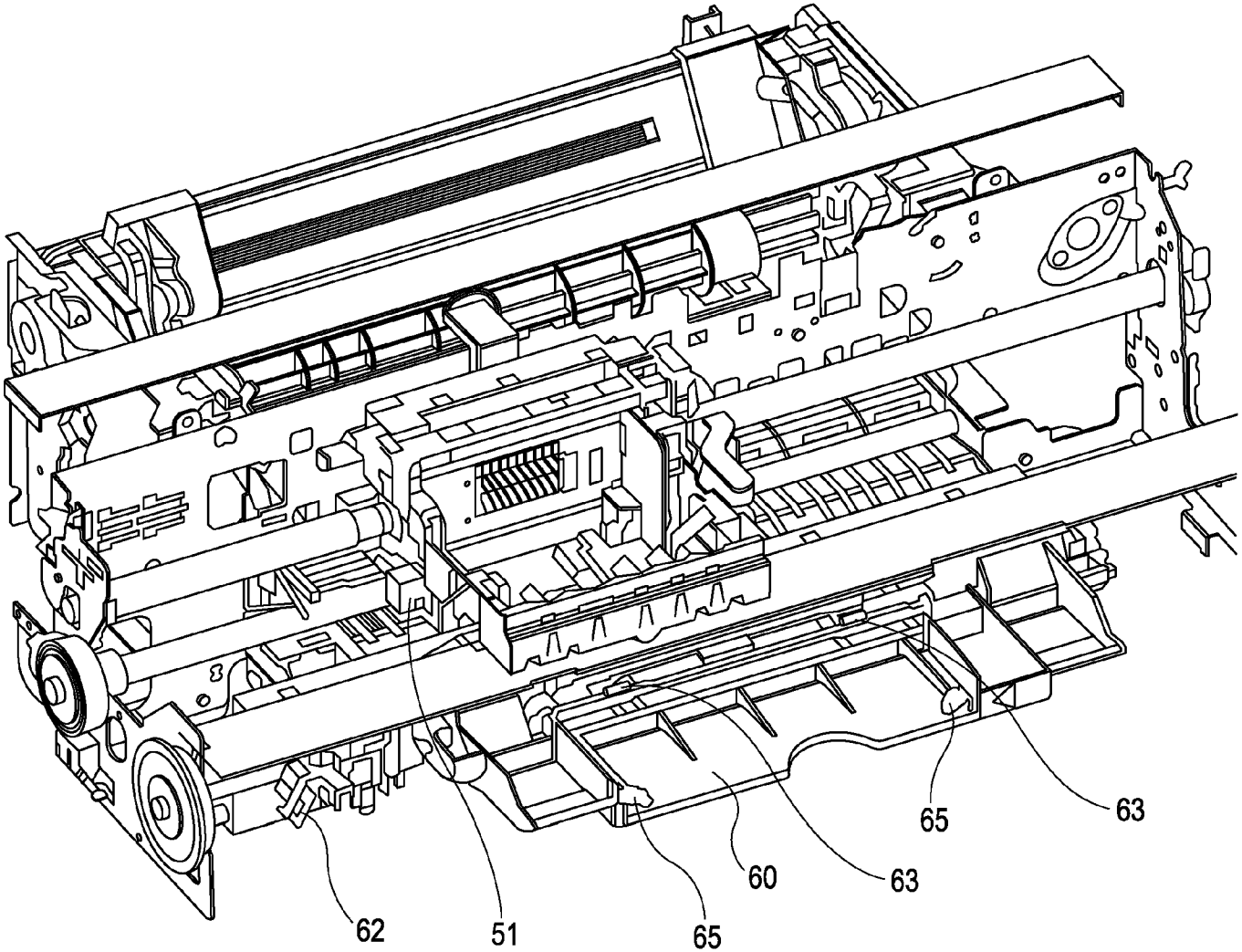
FIG. 4 is a perspective view of the recording apparatus shown in FIG. 1, with a CD tray base open, seen from the front left.

FIG. 1 is a perspective view of internal mechanisms of a recording apparatus according to a first embodiment of the present invention, seen from the front right. FIG. 2 is an outer perspective view of the recording apparatus shown in FIG. 1. FIG. 3 is a cross-sectional view of the recording apparatus shown in FIG. 1. FIG. 4 is a perspective view of the internal mechanisms of the recording apparatus shown in FIG. 1, with a CD tray base open, seen from the front left.

The recording apparatus of the first embodiment includes a feeding section, a conveying section, a discharging section, a carriage section, and a CD-printing-tray-feeding section. These sections will be outlined below in that order.

(A) Feeding Section

The feeding section includes a pressing plate 21 on which pieces of sheet material P, such as pieces of paper or overhead projector (OHP) films, are stacked, a feeding roller 25 that feeds the sheet material P, a separation roller 23 that separates pieces of the sheet material P, a return lever (not shown) that returns the sheet material P to a stacking position, and so forth. The foregoing components are all mounted on a base 20. A feeding tray (not shown) that holds a stack of the sheet material P is mounted on either the base 20 or an outer casing of the recording apparatus.

A feeding sequence will be described. When a motor is driven, the separation roller 23 is pressed against the feeding roller 25. Then, the return lever is released and the pressing plate 21 is pressed against the feeding roller 25. In this state, feeding of the sheet material P starts. Since the sheet material P is regulated by an upstream separator (not shown) mounted on the base 20, only a predetermined number of pieces of the sheet material P are conveyed to a nip between the feeding roller 25 and the separation roller 23. Among the pieces of the sheet material P that have been conveyed to the nip, the topmost piece is separated from the others at the nip and is fed to the downstream side.

When the separated piece of the sheet material P reaches another nip between a conveying roller 36 and pinch rollers 35, which will be described separately below, the pressing plate 21 and the separation roller 23 are released by a pressing plate cam (not shown) and a control cam (not shown), respectively. Further, the return lever is returned to the stacking position by the control cam. Thus, the remaining pieces of the sheet material P at the nip between the feeding roller 25 and the separation roller 23 can be returned to the stacking position.

(B) Conveying Section

The conveying roller 36 included in the conveying section is provided with a plurality of pinch rollers 35 that rotate following the rotation of the conveying roller 36 by being pressed thereagainst. The pinch rollers 35 are held by a pinch roller holder 30 and are pressed against the conveying roller 36 with an urging force produced by pinch roller springs (not shown), whereby a force with which the sheet material P is conveyed is produced. The pinch roller holder 30 has a shaft of rotation attached to a chassis 11, thereby being rotatable about the shaft. A paper guide flapper 33 that guides the sheet material P is provided at the entrance of the conveying section to which the sheet material P is conveyed. The paper guide flapper 33 turnably engages with the conveying roller 36 and is positioned by being in contact with the chassis 11. The pinch roller holder 30 is provided with a PE sensor 32 that detects the leading end and the trailing end of the sheet material P.

In the configuration described above, the sheet material P that has been conveyed to the conveying section is guided by the pinch roller holder 30 and the paper guide flapper 33 to the nip between the conveying roller 36 and the pinch rollers 35. At this time, the PE sensor 32 detects the leading end of the sheet material P that has been conveyed therebelow, whereby the recording position on the sheet material P is determined. The sheet material P is conveyed along a platen 45, which will be described below, by the rollers 35 and 36, working in a pair, rotated by a conveying motor (not shown) and reaches the discharging section.

(C) Discharging Section

The discharging section includes the platen 45, two discharging rollers 40 and 41 provided on the platen 45, and spurs 42 urged by springs against the discharging rollers 40 and 41 in such a manner as to rotate following the rotation of the discharging rollers 40 and 41. The spurs 42 are held by a spur holder 43. The spur holder 43 is urged by a holder urging spring 44 against the platen 45. When the spur holder 43 is raised by a release arm (not shown), which will be described below, nips between the spurs 42 and the discharging rollers 40 and 41 are loosened. The platen 45 has a ribbed upper surface, which forms a reference conveying surface. The ribs in the reference conveying surface are provided for controlling a gap between the reference conveying surface and a recording head 55 and for suppressing waving (cockling) of the sheet material P.

In the configuration described above, the sheet material P that has been conveyed to the discharging section is further conveyed and discharged by the discharging rollers 40 and 41 that are driven synchronously with the conveying roller 36.

(D) Carriage Section

Figure 5:
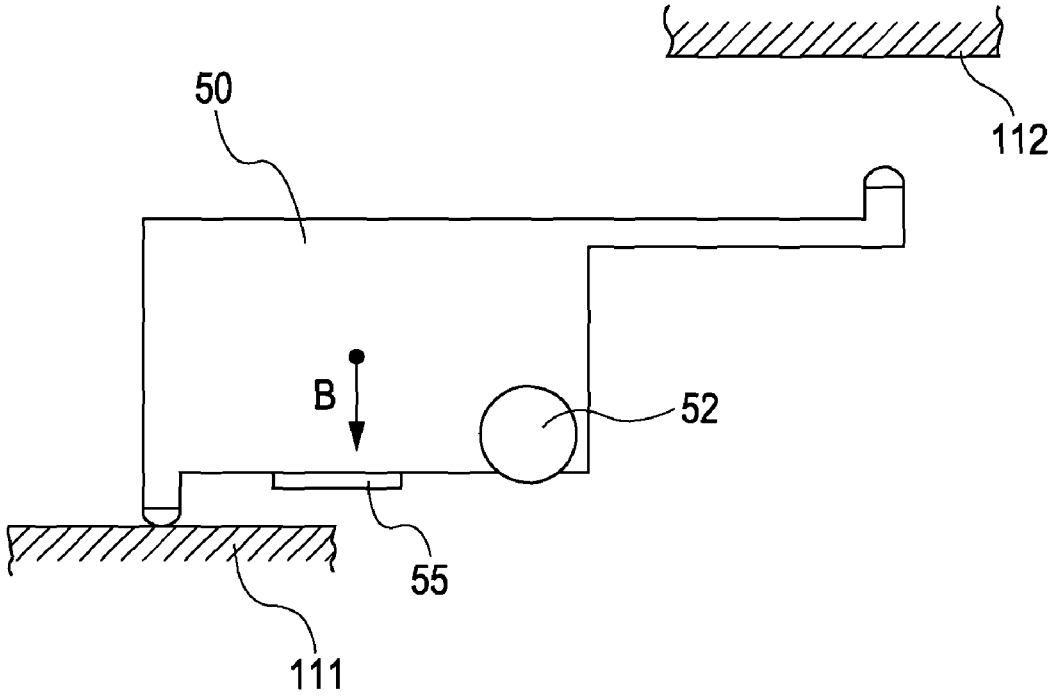
FIG. 5 is a side view of a first guide rail and a second guide rail that control the posture of a carriage to be held at different gap determining positions.

The carriage section will be described. FIG. 5 is a side view of relevant parts of the recording apparatus schematically showing the positional relationship between a carriage 50 and two controlling guide members (a first guide rail 111 and a second guide rail 112) that control the posture of the carriage 50 at gap determining positions corresponding to various thicknesses of different sheet media. Referring to FIGS. 1, 3, and 5, the carriage section includes the carriage 50 having the recording head 55 mounted thereon. The carriage 50 is rotatably supported by a guide shaft 52, serving as a carriage guiding member, that extends crossing (specifically, orthogonally to) a direction in which the sheet material P is conveyed (hereinafter also referred to as a recording medium conveying direction). The posture of the carriage 50 is determined when the carriage 50 is in contact with one of the first guide rail 111 (a first guide member) and the second guide rail 112 (a second guide member), whereby the gap and parallelism between the recording head 55 and the target surface of the recording medium are maintained. A mechanism that adjusts the gap will be described separately below. The guide shaft 52 is provided at both ends thereof with a right eccentric cam 521 and a left eccentric cam 522, respectively. With the right and left eccentric cams 521 and 522 that are driven by a motor, the guide shaft 52 can be raised and lowered. The carriage 50 is driven by a carriage motor 53, which is mounted on the chassis 11, with the aid of a timing belt 531, thereby being capable of moving back and forth in a direction orthogonal to the recording medium conveying direction. The timing belt 531 is tensed by an idler pulley 532.

The carriage 50 is provided with a detection sensor 51, serving as a reflective optical sensor, that detects a position detection mark provided on a CD printing tray. The detection sensor 51 can detect the position of the tray by emitting light from a light-emitter and receiving the reflection of the light from the tray.

To form an image on the sheet material P in the configuration described above, the sheet material P is conveyed by the conveying roller 36 and the pinch rollers 35 to a position corresponding to a line to be recorded (a position in the path along which the sheet material P is conveyed). Then, the carriage 50 is moved by the carriage motor 53 to a position where the image is to be formed, in such a manner that the recording head 55 faces the aforementioned position. Subsequently, the recording head 55 ejects ink toward the sheet material P in accordance with a signal from an electrical section. Thus, the image is formed.

(E) CD-Printing-Tray-Feeding Section

The CD-printing-tray-feeding section includes a CD tray base 60 turnably attached to the outer casing of the recording apparatus, the release arm moving together with the CD tray base 60 and having a cam raising and lowering the spur holder 43, and a spur holder sensor 62 detecting whether the spur holder 43 is being raised or lowered. The CD tray base 60 includes pinch rollers 63, roller springs (not shown) provided as spring shafts fitted in the pinch rollers 63, and guide rollers 65. The CD printing tray is urged against the discharging rollers 40 and 41 with a pressing force produced by the roller springs. Therefore, a sufficient conveying force can be obtained only by the discharging rollers 40 and 41.

In the configuration described above, when the CD tray base 60 is turned forward, the release arm is moved together therewith in such a manner as to raise the spur holder 43, whereby a space is provided between the platen 45 and the spur holder 43. The CD printing tray can pass through the space. When the spur holder 43 is raised, part of the spur holder 43 presses the spur holder sensor 62. Thus, the CD tray base 60 is detected to be opened.

Next, a mechanism that adjusts the gap between the recording medium and the recording head of the recording apparatus according to the first embodiment of the present invention will be described.

Figure 6A:
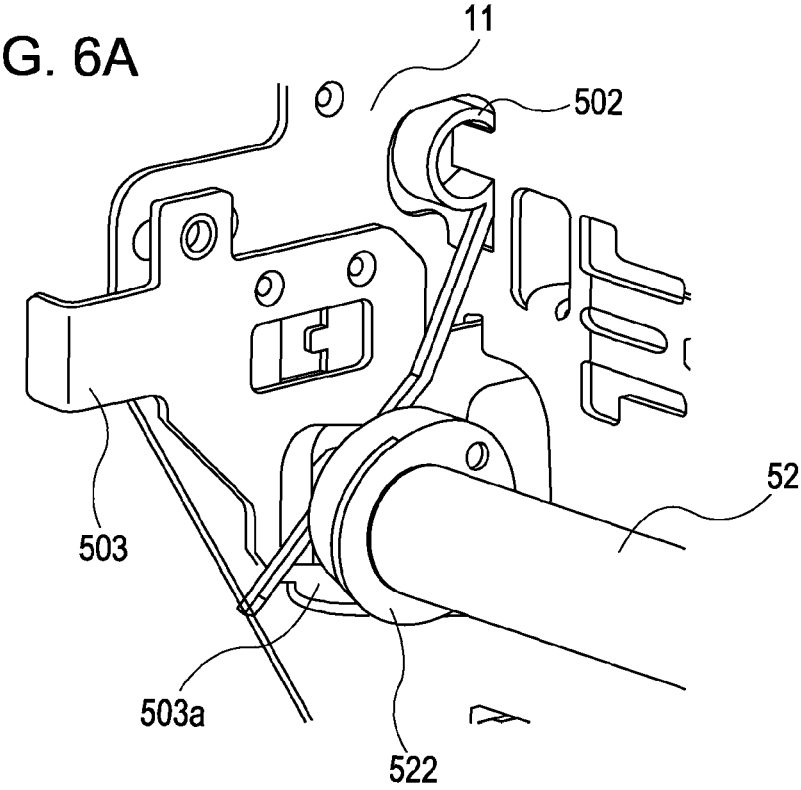
FIGS. 6A and 6B are perspective views of relevant parts showing states where a guide shaft is supported at the left end and the right end, respectively, thereof in a case where a guide shaft elevation mechanism of the recording apparatus according to the first embodiment of the present invention is positioned at a normal printing height.
Figure 6B:
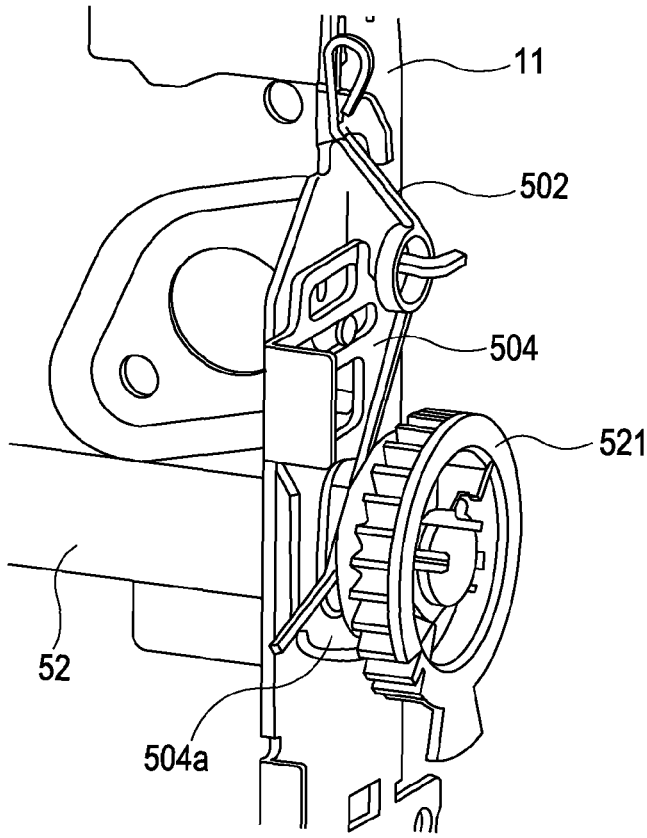

FIG. 6A is a perspective view of relevant parts showing a state where the guide shaft 52 is supported at the left end thereof in a case of normal printing. FIG. 6B is a perspective view of relevant parts showing a state where the guide shaft 52 is supported at the right end thereof in the case of normal printing. Referring to FIGS. 6A and 6B, the height of the guide shaft 52 in the case of normal printing (the height of the carriage 50 determined for controlling the interval between the recording head 55 and the recording medium) is determined as follows. The right eccentric cam 521 and the left eccentric cam 522 provided at the respective ends of the guide shaft 52 are brought into contact with a right-eccentric-cam stopper 504*a* and a left-eccentric-cam stopper 503*a*, respectively, whereby the position of the carriage 50 is determined. The left-eccentric-cam stopper 503*a* is a sloping surface of a left gap adjuster 503, and the right-eccentric-cam stopper 504*a* is a sloping surface of a right gap adjuster 504. The right and left eccentric cams 521 and 522 are urged by guide shaft springs 502 against the respective stoppers 504*a* and 503*a* via the guide shaft 52. The position of the guide shaft 52 in the recording medium conveying direction is determined by being urged by the guide shaft springs 502 against a vertical surface of the chassis 11 serving as the frame of the recording apparatus. Therefore, even if the height of the guide shaft 52 is changed, the position of the guide shaft 52 in the recording medium conveying direction is not changed and is correctly retained at a predetermined position with respect to the vertical surface of the chassis 11.

Since the left-and right-eccentric-cam stoppers 503*a* and 504*a* are sloping surfaces, slight adjustment of the height of the guide shaft 52 is possible in normal printing by causing the left and right eccentric cams 522 and 521 to slidably rotate on the left and right gap adjusters 503 and 504, respectively. The height of the guide shaft 52 in normal printing corresponds to a normal printing height, the minimum height, and the initial height. The right eccentric cam 521 includes a cam plate and a gear. A driving force (rotating force) is transmitted from a carriage elevation motor (not shown) via a series of drive gears to the gear of the right eccentric cam 521.

In other words, the carriage elevation motor controls the position to which the right eccentric cam 521 is rotated, whereby the height of the guide shaft 52 can be adjusted.

On the other hand, the left eccentric cam 522 provided on the left end of the guide shaft 52 is fixed to the guide shaft 52 and is rotated synchronously with the right eccentric cam 521.

The height of the carriage 50 is determined at an arbitrary position by the above-described mechanism that raises and lowers the carriage 50, while the posture of the carriage 50 is determined by the contact thereof with the first guide rail 111 or the second guide rail 112. The carriage 50, which is rotatably supported by the guide shaft 52, is subjected to a force (acting in a direction B shown in FIG. 5) produced by its own weight causing the carriage 50 to rotate about the guide shaft 52 in the radial direction. The first guide rail 111 and the second guide rail 112 stop the radial rotation of the carriage 50, thereby determining the posture of the carriage 50. Referring to FIG. 5, the second guide rail 112 is provided on the upstream side of the guide shaft 52 in the recording medium conveying direction, and the first guide rail 111 is provided on the downstream side of the guide shaft 52 in the same direction. In short, the first and second guide rails 111 and 112 are provided on respective sides of the guide shaft 52 in the sheet material conveying direction. The carriage 50 is in contact with the first guide rail 111 when positioned at the normal printing height, and with the second guide rail 112 when positioned at a CD printing height.

Figure 7A:
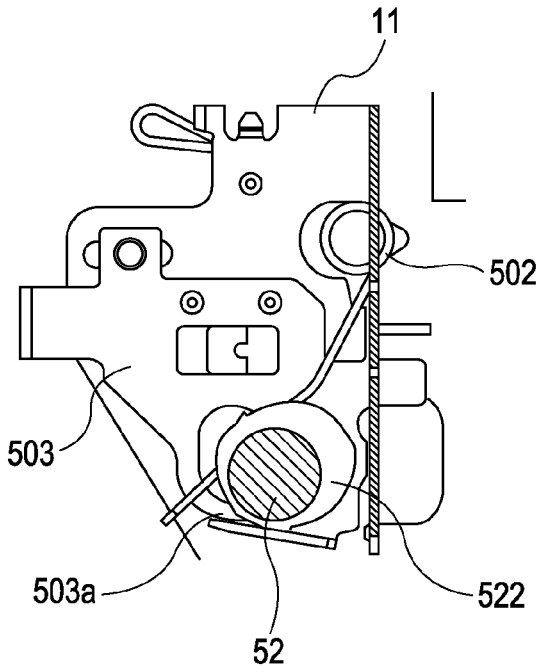
FIG. 7A is a side view schematically showing the position of a left eccentric cam at the normal printing height.
Figure 7B:
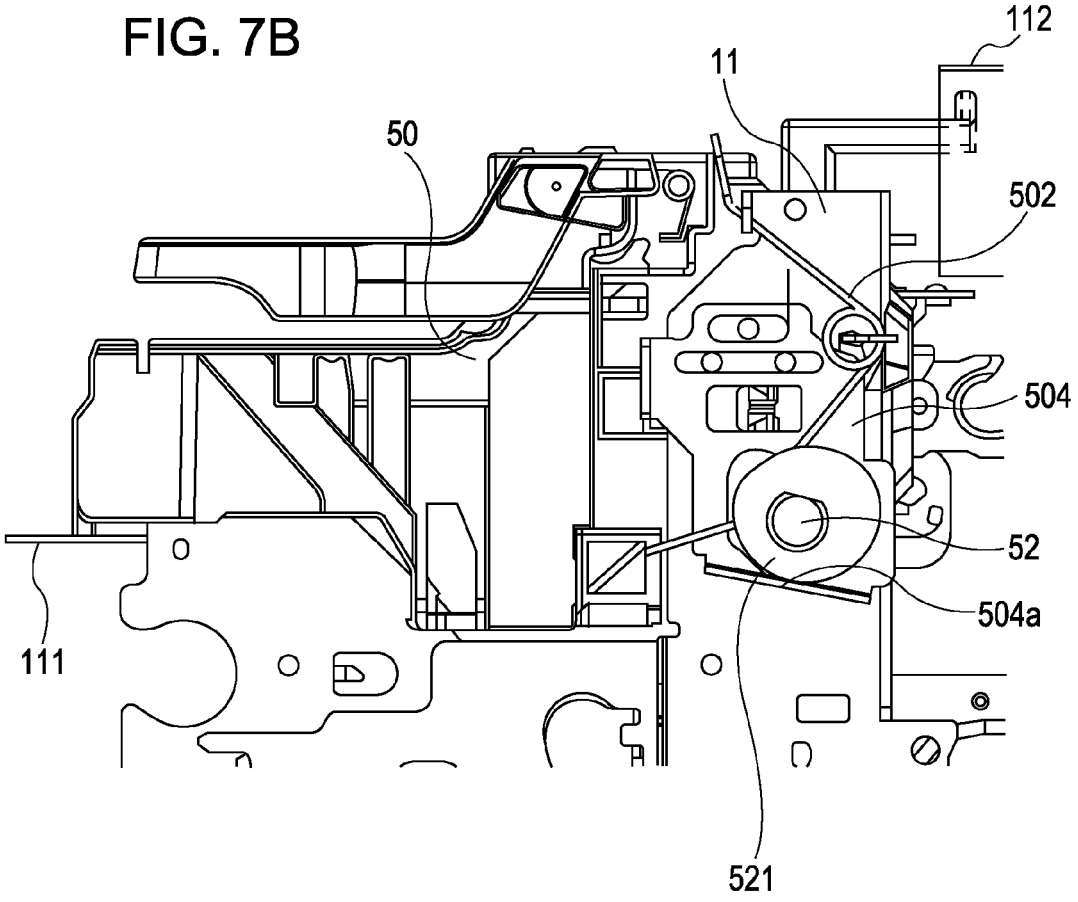
FIG. 7B is a side view schematically showing the position of a right eccentric cam and the posture of the carriage at the normal printing height.

FIG. 7A is a side view schematically showing the position of the left eccentric cam 522 at the normal printing height. FIG. 7B is a side view schematically showing the position of the right eccentric cam 521 and the posture of the carriage 50 at the normal printing height. At the normal printing height, the left and right eccentric cams 522 and 521 are in contact with the left-and right-eccentric-cam stoppers 503*a* and 504*a*, respectively, at positions on the cam plates thereof corresponding to the minimum height. In this state, the carriage 50 is in contact with the first guide rail 111, whereby the recording head 55 can be maintained parallel to the target surface of the recording medium.

Figure 8A:
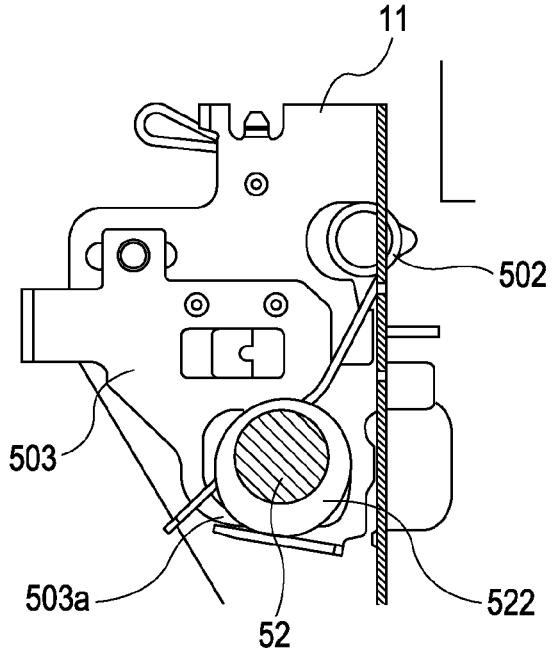
FIG. 8A is a side view schematically showing the position of the left eccentric cam at a CD printing height.
Figure 8B:
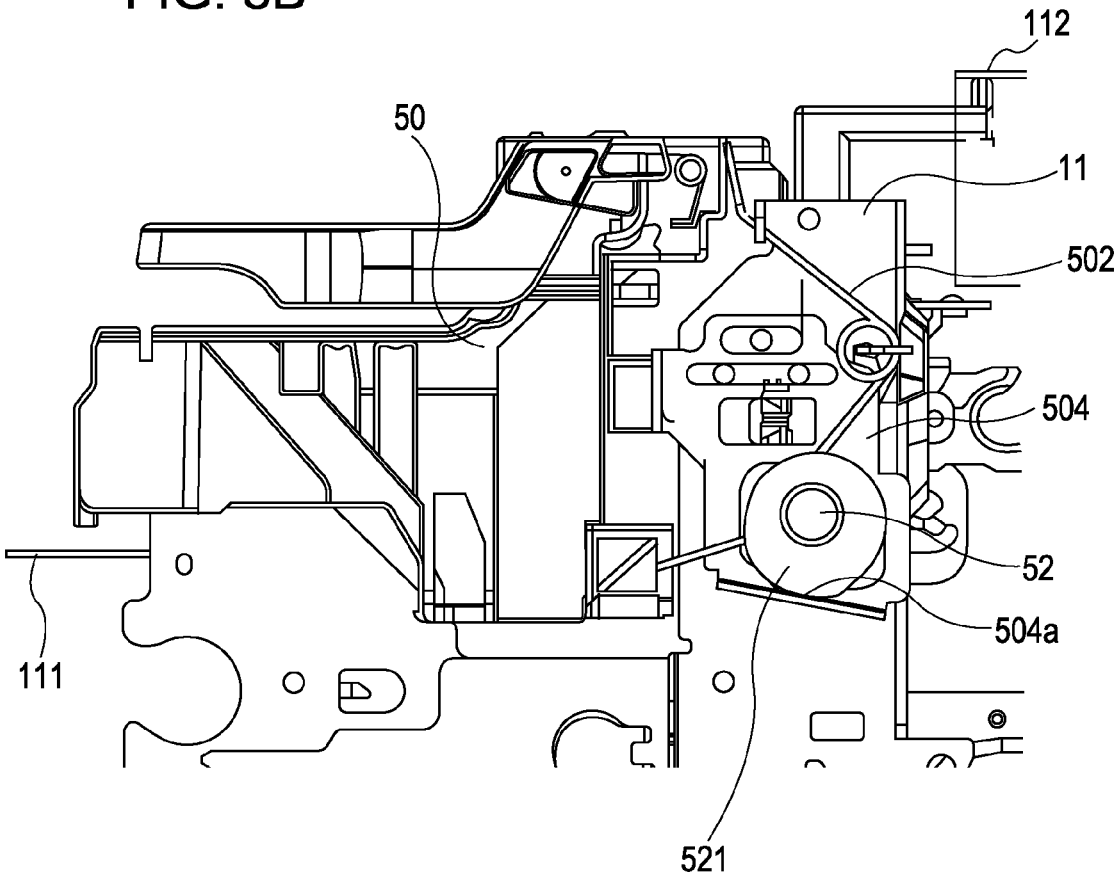

FIG. 8A is a side view schematically showing the position of the left eccentric cam 522 at the CD printing height. FIG. 8B is a side view schematically showing the position of the right eccentric cam 521 and the posture of the carriage 50 at the CD printing height. When the left and right eccentric cams 522 and 521 are at the respective positions shown in FIGS. 8A and 8B, the guide shaft 52 is positioned at the maximum height, and so is the carriage 50. The posture of the carriage 50 is controlled by being in contact with the second guide rail 112, whereby the recording head 55 can be maintained parallel to the target surface of the recording medium.

Figure 9A:
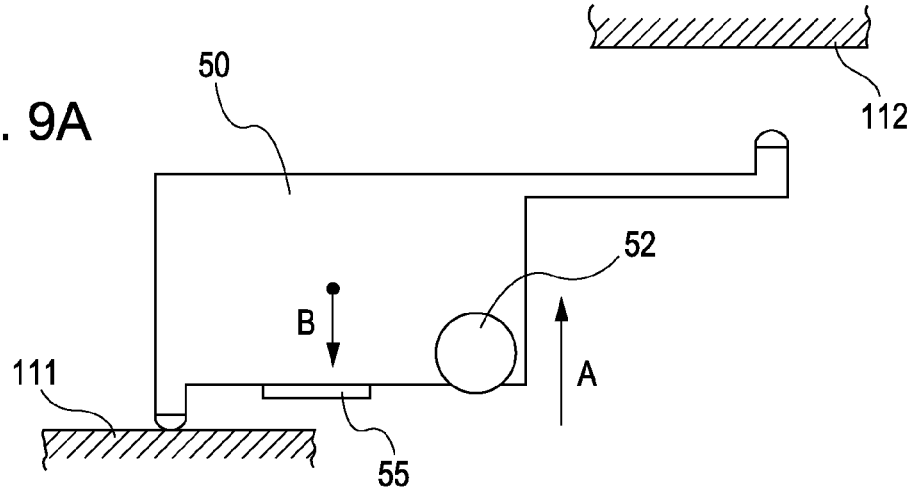
FIGS. 9A to 9C are side views schematically showing respective states of contact between the carriage and the first and second guide rails during gap adjustment from the normal printing height to the CD printing height.
Figure 9B:
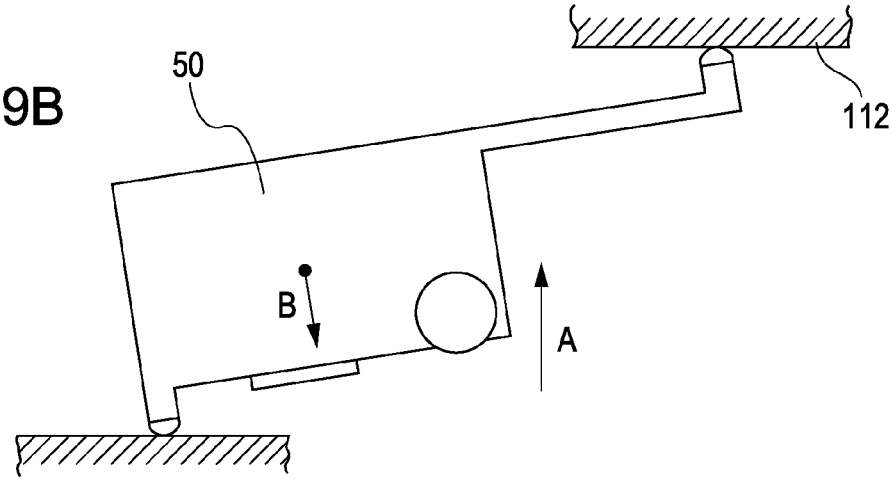
Figure 9C:
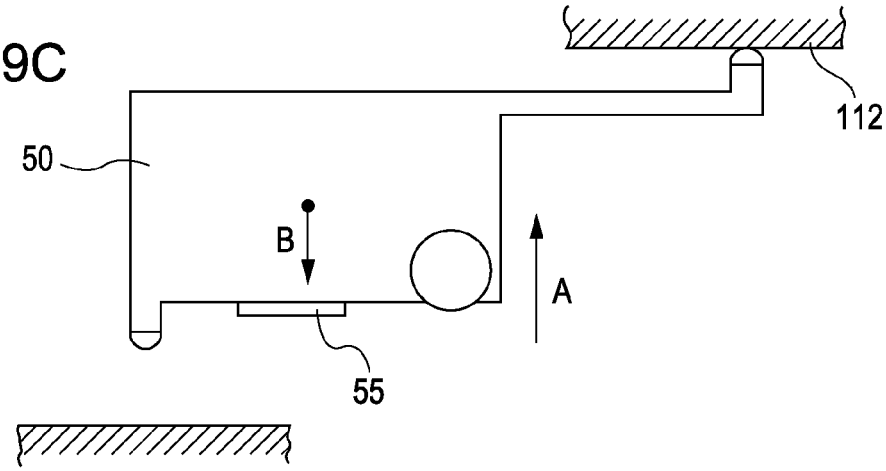

Next, an operation of adjusting the gap in the case of performing recording on a CD, or CD printing, will be described. FIGS. 9A to 9C are side views schematically showing states of contact between the carriage 50 and the first and second guide rails 111 and 112 during the adjustment of the height of the recording head 55 from the normal printing height to the CD printing height.

In the state shown in FIGS. 7A and 7B where the guide shaft 52 is positioned at a height for normal printing (the normal printing height), a current is applied to the carriage elevation motor for a predetermined time, whereby the carriage elevation motor is driven. In response to this, the right eccentric cam 521 is rotated counterclockwise when seen from the right, i.e., in the view shown in FIG. 7B. Since the right eccentric cam 521 and the left eccentric cam 522 are unrotatably fixed to the respective ends of the guide shaft 52 as described above, the guide shaft 52 and the left eccentric cam 522 are also rotated in the same direction synchronously with the rotation of the right eccentric cam 521.

As the guide shaft 52 starts to be raised, the carriage 50 also starts to be raised (in a direction A shown in FIGS. 9A to 9C). The carriage 50 being in contact with the first guide rail 111 (as shown in FIG. 9A) comes into contact also with the second guide rail 112 when the guide shaft 52 reaches a position shown in FIG. 9B. When the carriage 50 is raised higher than the position shown in FIG. 9B, the carriage 50 is in contact with only the second guide rail 112.

When the left eccentric cam 522 and the right eccentric cam 521 are positioned as shown in FIGS. 8A and 8B, the recording head 55 mounted on the carriage 50 reaches the CD printing height. In this state, the carriage 50 is appropriately in contact with the second guide rail 112 (as shown in FIG. 9C), whereby the recording head 55 is positioned so as to be parallel to the target surface of the recording medium.

To return the guide shaft 52 to the normal printing height after the recording on the CD is finished, the carriage elevation motor (not shown) is driven by applying a current thereto for a predetermined time in a state where the guide shaft 52 is still positioned at the CD printing height. In response to this, the right eccentric cam 521 is rotated clockwise when seen from the right, i.e., in the view shown in FIG. 8B.

Then, the cam plates of the left and right eccentric cams 522 and 521 start to slidably rotate on the left-and right-eccentric-cam stoppers 503*a* and 504*a* of the left and right gap adjusters 503 and 504. Accordingly, the interval between the center of the guide shaft 52 and the left-and right-eccentric-cam stoppers 503*a* and 504*a* starts to be reduced, whereby the guide shaft 52 starts to be lowered. Ultimately, the guide shaft 52 is returned to the normal printing height (the position shown in FIGS. 7A and 7B). The carriage 50 that had been in contact with the second guide rail 112 at the position shown in FIG. 9B comes into contact with only the first guide rail 111 when lowered therebelow. The carriage 50 that has reached the normal printing height has the posture thereof determined by the first guide rail 111 being in contact therewith (as shown in FIG. 9A).

With the configuration described above, recording on recording media having various thicknesses can be performed in a compact and low-cost apparatus by appropriately adjusting the gap between the recording head and any of the recording media while maintaining the parallelism therebetween.

While the first embodiment concerns gap adjustment in the case where the recording medium is a CD, the type of the recording medium is not limited thereto. Further, in the first embodiment, the posture of the carriage is determined in such a manner that the recording head and the target surface of the recording medium are maintained parallel to each other so as to maintain high printing quality. Therefore, the gap is adjusted between only two heights. However, in the case of other recording media, such as plain paper, that do not require very high printing quality, the gap may be adjusted between more than two heights if the parallelism between the recording head and the target surface can be sacrificed.

Now, a second embodiment concerning a modification of the mechanism that adjusts the gap between the recording medium and the recording head of the recording apparatus according to the first embodiment of the present invention will be described. Hereinafter, elements the same as those in the first embodiment will be denoted by the same reference numerals.

Figure 10:
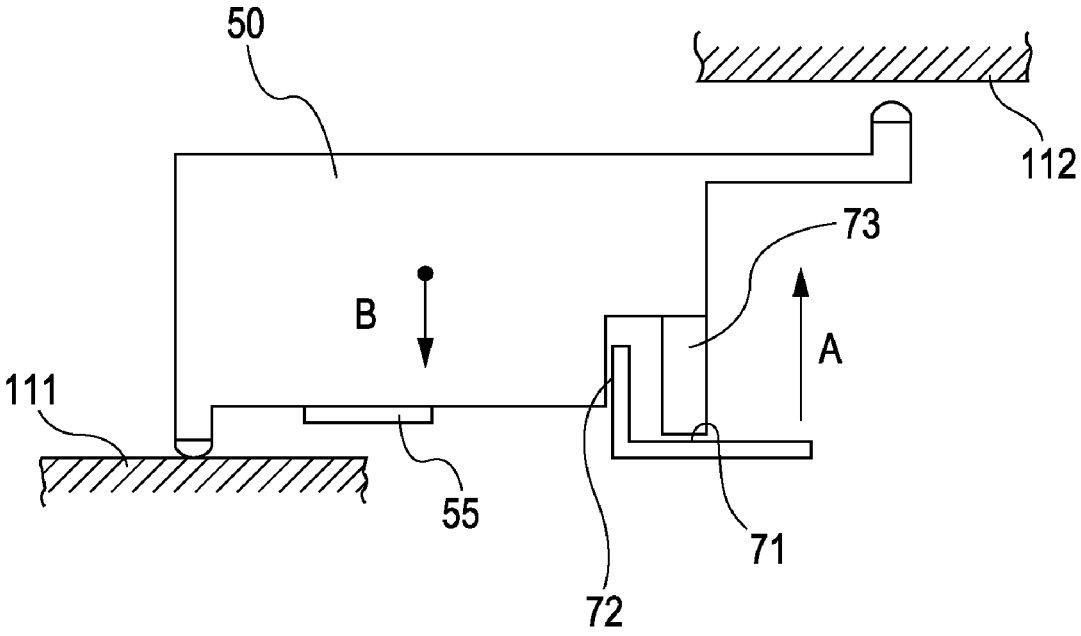
FIG. 10 is a side view schematically showing a second embodiment of the present invention.

In the first embodiment, the guide shaft 52 is used as a supporting member on which the carriage 50 is rotatably mounted. In the second embodiment, a rail member shown in FIG. 10 is used. The rail member includes two surfaces that are provided close but not parallel to each other. With these two surfaces, the carriage 50 is rotatably supported.

In the second embodiment, referring to FIG. 10, the carriage 50 is rotatably supported by two supporting surfaces 71 and 72. The carriage 50 is in contact with the supporting surface 71, which extends crossing the gap adjusting direction, with a spacer 73 interposed therebetween. The thickness of the spacer 73 is changeable in the gap adjusting direction. By appropriately changing the thickness of the spacer 73, the height of the recording head 55 is adjusted. The spacer 73 is firmly secured to the carriage 50 during printing but is made to be movable with a trigger applied when printing is not being performed. This trigger enables gap adjustment. Alternatively, such gap adjustment may be performed by moving the spacer 73 relative to the carriage 50 by a drive source (not shown) or the like provided to the recording apparatus.

Next, a third embodiment concerning a modification of the mechanism that adjusts the gap between the recording medium and the recording head of the recording apparatus according to the first embodiment of the present invention will be described.

In each of the first and second embodiments, the contact surfaces of the guide rails are perpendicular to the gap adjusting direction (the direction in which the carriage is raised and lowered). Alternatively, the contact surfaces of the guide rails may be tilted from a line perpendicular to the gap adjusting direction.

Figure 11A:
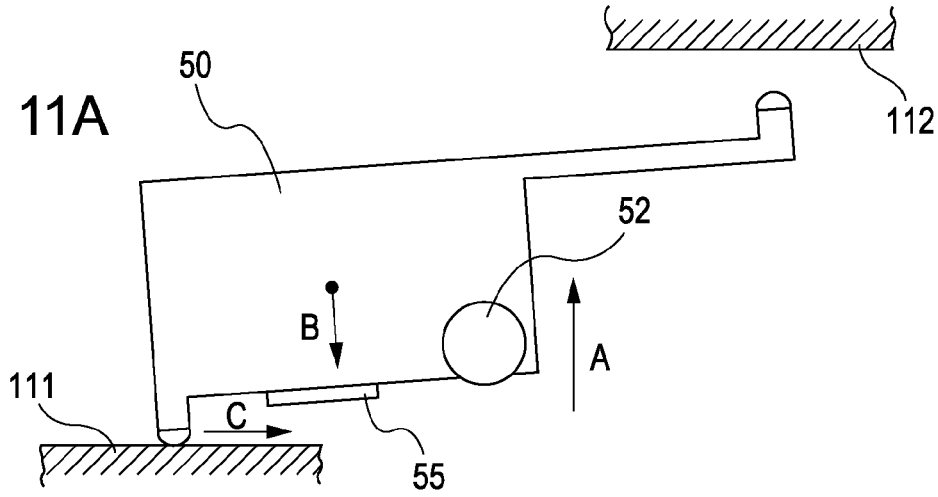
FIGS. 11A to 11C are side views schematically showing respective states of contact between the carriage and the first and second guide rails during gap adjustment from the normal printing height to the CD printing height in the recording apparatus according to the first embodiment.
Figure 11B:
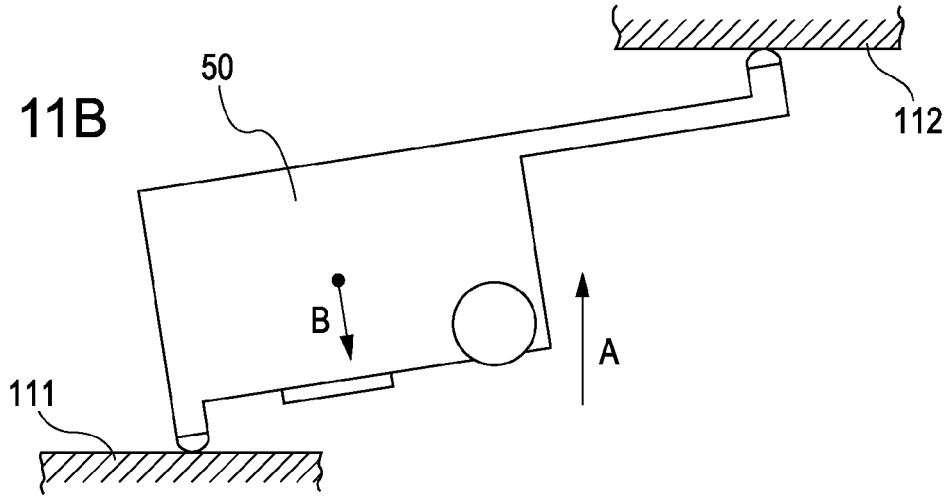
Figure 11C:
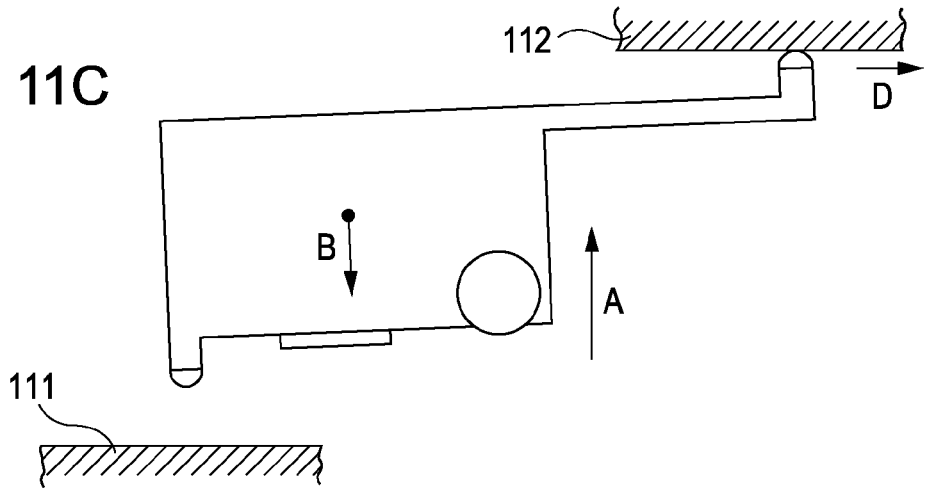

FIGS. 11A to 11C each show relevant parts of the recording apparatus according to the first embodiment during gap adjustment from the normal printing height, at which the gap is relatively small, to the CD printing height, at which the gap is relatively large. In this case, the guide rails are disposed perpendicularly to the gap adjusting direction.

FIG. 11A shows a state where the carriage 50 is in contact with only the first guide rail 111. FIG. 11B shows a state where the carriage 50 is in contact with both the first and second guide rails 111 and 112. FIG. 11C shows a state where the carriage 50 is in contact with only the second guide rail 112.

Referring to FIG. 11A, while the carriage 50 is raised from the initial position to the position shown in FIG. 11B, the carriage 50 is softly in contact with the first guide rail 111 in such a manner as to be slidable in a direction substantially perpendicular to the gap adjusting direction. Therefore, the carriage 50 can be moved smoothly during gap adjustment. In this state, referring to FIG. 11A, the carriage 50 slides on the first guide rail 111 in a direction C, while the gap is adjusted in a direction A.

After the carriage 50 reaches the position shown in FIG. 11B during gap adjustment, the carriage 50 is in contact with only the second guide rail 112 as shown in FIG. 11C. In this state, the carriage 50 is hardly in contact with the second guide rail 112 in such a manner as to be not easily slidable in a direction substantially perpendicular to the gap adjusting direction. That is, the carriage 50 is strongly pressed against, or bites, the second guide rail 112 during gap adjustment. This may cause chatter vibration such as stick-slipping. In this state, referring to FIG. 11C, the carriage 50 is stopped from sliding on the second guide rail 112 in a direction D, while the gap is adjusted in a direction A.

Conversely, in the case where the carriage 50 is lowered from the CD printing height providing a large gap to the normal printing height providing a small gap, the carriage 50 bites the first guide rail 111.

Figure 12:
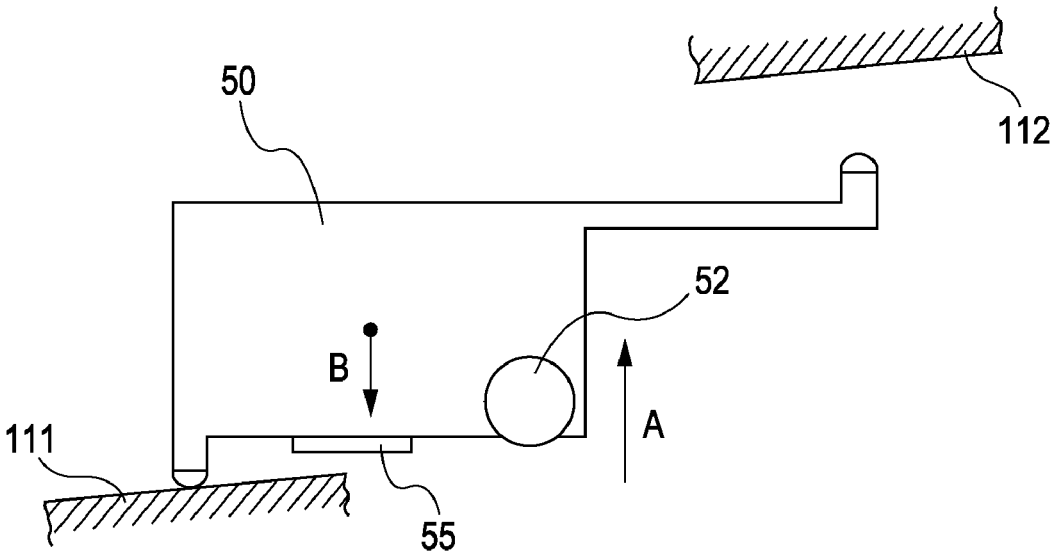
FIG. 12 is a side view schematically showing a third embodiment of the present invention.

In view of such biting, referring to FIG. 12, the first and second guide rails 111 and 112 of the second embodiment are tilted from the line perpendicular to the gap adjusting direction A. Thus, the occurrence of biting described above during gap adjustment can be prevented.

Next, a fourth embodiment concerning a modification of the mechanism that adjusts the gap between the recording medium and the recording head of the recording apparatus according to the first embodiment of the present invention will be described.

Figure 13A:
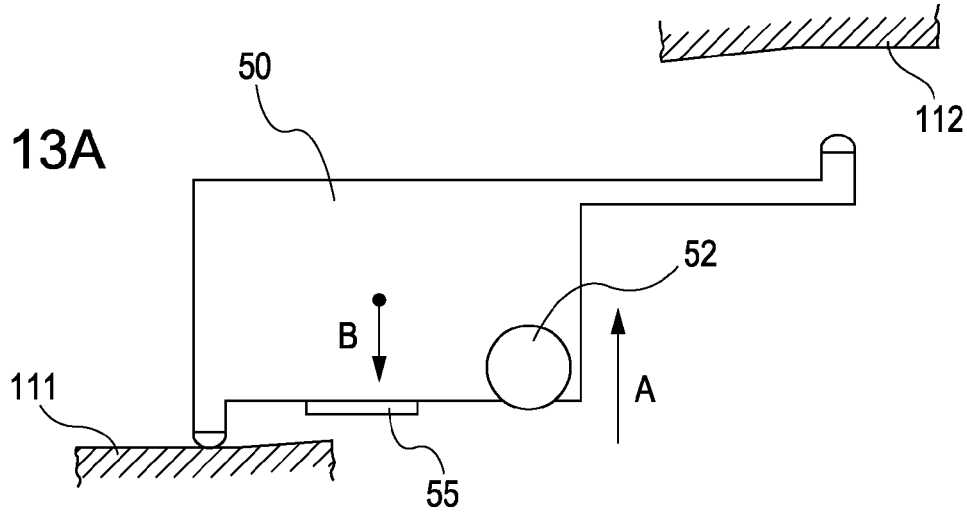
FIG. 13 is a side view schematically showing a fourth embodiment of the present invention.
Figure 13B:
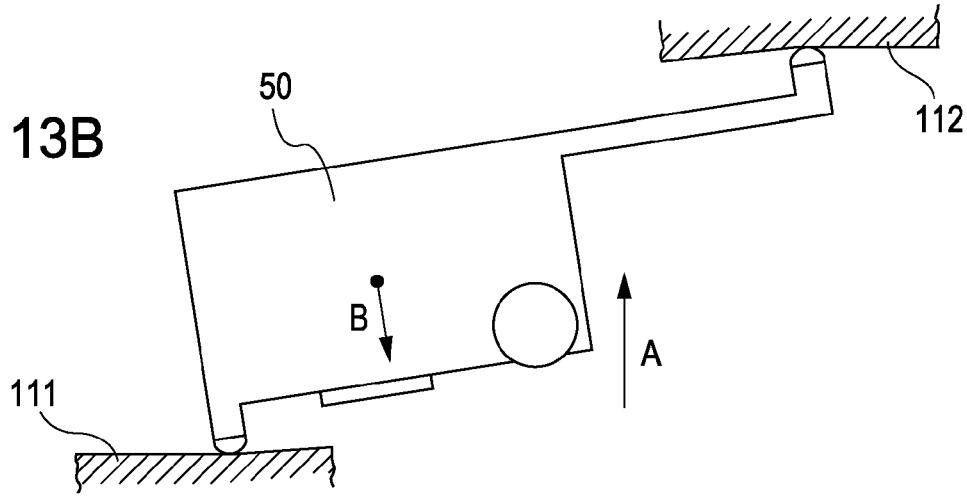
Figure 13C:
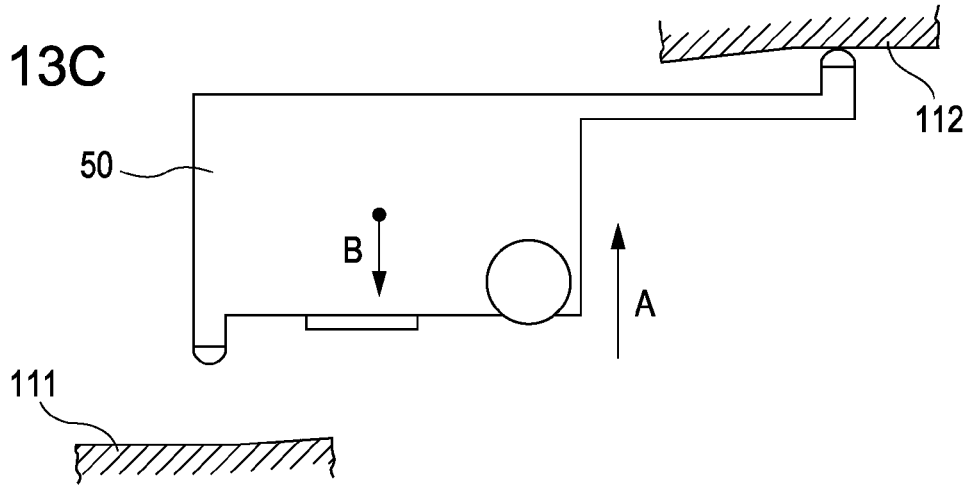

The fourth embodiment solves the problem of biting occurring during gap adjustment by employing a configuration shown in FIGS. 13A to 13C. Referring to FIGS. 13A to 13C, portions of the first and second guide rails 111 and 112 that are to be bitten by the carriage 50 during gap adjustment, i.e., while the carriage 50 is being raised or lowered, are tilted from the line perpendicular to the gap adjusting direction. The other portions of the first and second guide rails 111 and 112 that are to be in contact with the carriage 50 after gap adjustment, i.e., after the length of the gap is determined, are oriented perpendicular to the gap adjusting direction. Such a configuration has a merit in that management of the dimensions of relevant components in the manufacturing process becomes easier, whereby required positional accuracy after gap adjustment can be easily satisfied.

Next, a fifth embodiment concerning a modification of the mechanism that adjusts the gap between the recording medium and the recording head of the recording apparatus according to the first embodiment of the present invention will be described.

Figure 14A:
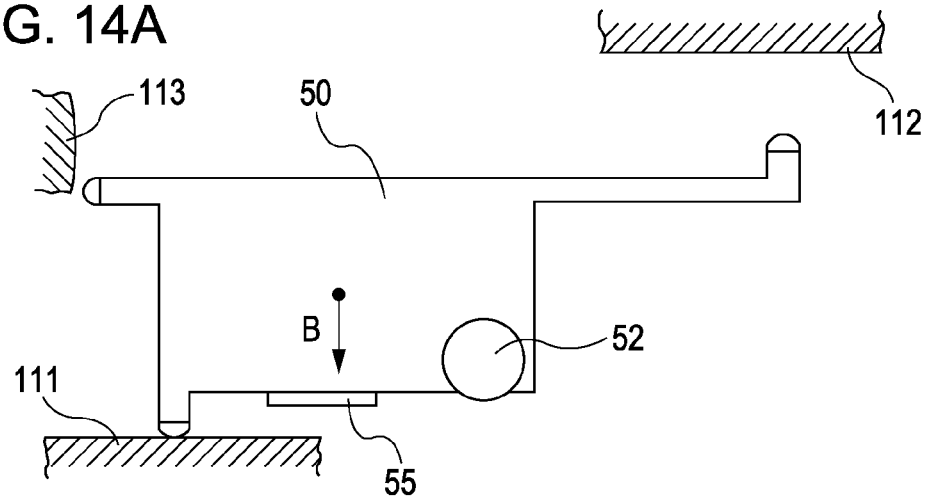
FIG. 14 is a side view schematically showing a fifth embodiment of the present invention.
Figure 14B:
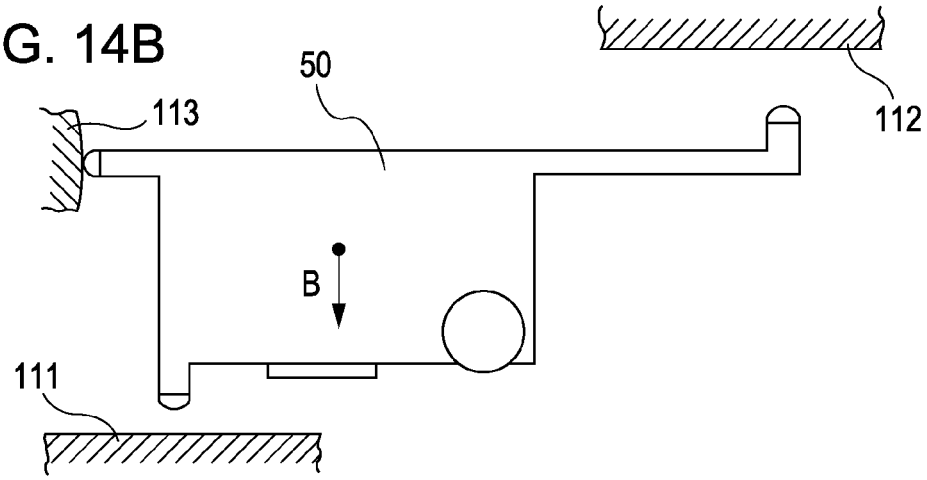
Figure 14C:
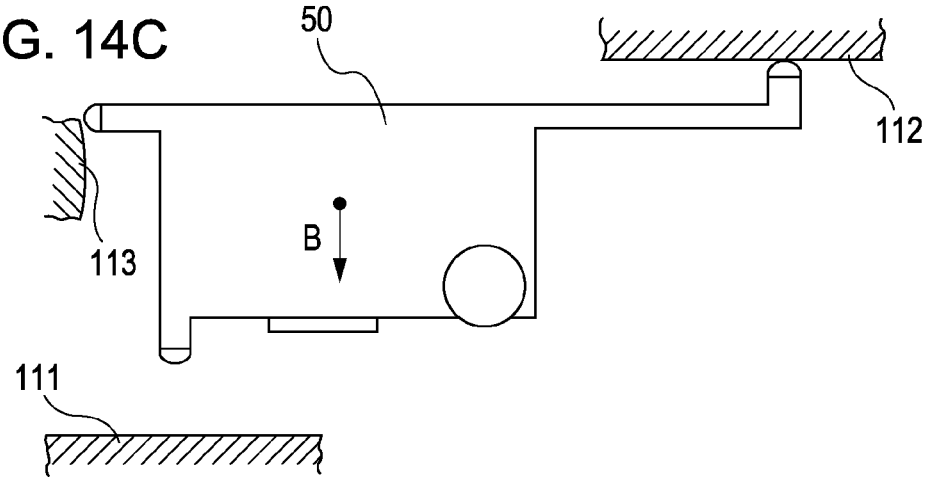
Figure 15:
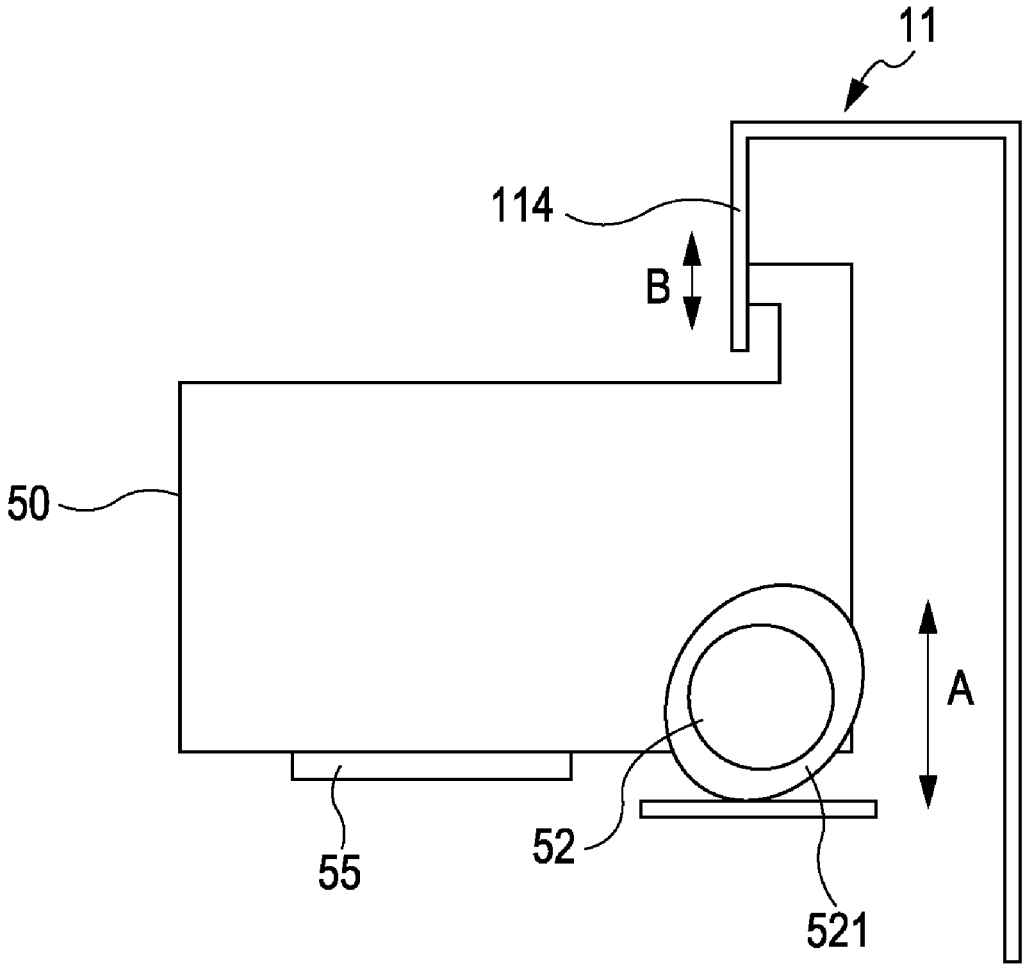
FIG. 15 PRIOR ART
FIG. 15 shows a recording apparatus according to the related art.

Referring to FIGS. 14A to 14C, a mechanism of the fifth embodiment includes a third guide rail 113 (a third guide member) having a surface substantially perpendicular to the first and second guide rails 111 and 112. The third guide rail 113 is configured to be in contact with the carriage 50 during gap adjustment at a position between the first and second guide rails 111 and 112. In other words, the third guide rail 113 is disposed in the path along which the carriage 50 is raised and lowered between the contact surfaces of the first and second guide rails 111 and 112. In such a configuration, three gap determining positions as shown in FIGS. 14A to 14C can be provided.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

According to the embodiments described above, a compact and low-cost recording apparatus capable of performing recording on recording media having various thicknesses by appropriately adjusting the gap between the recording head and any of the recording media while maintaining the parallelism therebetween can be provided.

This application claims the benefit of Japanese Patent Application No. 2007-323328 filed Dec. 14, 2007, which is hereby incorporated by reference herein in its entirety.

What is claimed is:

1. A recording apparatus comprising:

a carriage having a recording unit configured to perform recording on a recording medium, the carriage being movable in a direction crossing a recording medium conveying direction;

a carriage guiding member configured to guide the carriage and on which the carriage is rotatably supported, a height of the carriage guiding member being changeable, whereby the carriage is raised and lowered; and first and second guide members configured to be in contact with the carriage in such a manner as to control a posture of the carriage, the first and second guide members being disposed on respective sides of the carriage guiding member in the recording medium conveying direction, wherein a length of a gap between the recording medium and the recording unit is changeable depending on the height of the carriage guiding member, and;

wherein when the carriage guiding member is at a lowered position, the first guide member contacts a first portion of the carriage and the second guide member separates from the carriage, and when the carriage guiding member is at a raised position, the second guide member contacts a second portion of the carriage and the first guide member separates from the carriage.

2. The recording apparatus according to claim 1, wherein the carriage guiding member is a guide shaft.

3. The recording apparatus according to claim 1, wherein the carriage guiding member is a rail member.

4. The recording apparatus according to claim 1, wherein surfaces of the first and second guide members that are to be in contact with the carriage face in a direction in which the carriage is raised and lowered.

5. The recording apparatus according to claim 1, wherein surfaces of the first and second guide members that are to be in contact with the carriage are tilted from a line perpendicular to a direction in which the carriage is raised and lowered.

6. The recording apparatus according to claim 1, wherein portions of the first and second guide members that are to be in contact with the carriage after the length of the gap is determined are perpendicular to a direction in which the carriage is raised and lowered, and portions of the first and second guide members that are to be in contact with the carriage while the carriage is being raised or lowered face in a direction tilted from a line perpendicular to the direction in which the carriage is raised and lowered.

7. The recording apparatus according to claim 1, further comprising:

a third guide member configured to determine a length of the gap by being in contact with the carriage at a position between a position where another length of the gap is determined by the carriage being in contact with the first guide member and a position where yet another length of the gap is determined by the carriage being in contact with the second guide member.

* * * * *